US005449966A

United States Patent [19]

Turkowski

[11] Patent Number: 5,449,966

[45] Date of Patent: * Sep. 12, 1995

[54] DOUBLE SLIDING SPARK PLUG - THUNDER II

[75] Inventor: Wojciech M. Turkowski, 1000 Rosensteel Ave., Silver Spring, Md. 20910

[73] Assignee: Wojciech Marian Turkowski, Silver Spring, Md.

[ * ] Notice: The portion of the term of this patent subsequent to Dec. 12, 2009 has been disclaimed.

[21] Appl. No.: 698,830

[22] Filed: Apr. 26, 1991

[51] Int. Cl.[6] ..... H01T 13/02; F02D 13/00

[52] U.S. Cl. ..... 313/131 R; 313/131 A; 313/130; 313/128; 123/169 EL

[58] Field of Search ..... 313/131 A, 131 R, 130, 313/128, 123, 138, 143 B, 169 EL

[56] References Cited

U.S. PATENT DOCUMENTS 3,538,372 11/1970 Terao ..... 313/131 R
4,439,707 3/1984 Hattori et al. ..... 313/131 A X
5,297,540 3/1994 Turkowski .

OTHER PUBLICATIONS

A. Borghese, M. Diang; "A Contribution to Spark Ignition Modelling"; IBID, IX Int. Conf., pp. 579–582, Sep. 1988.

F. Markus; "Lean-Burn Engine"; Car and Driver; Feb. 1992; pp. 72–75.

*Primary Examiner*—Donald J. Yusko
*Assistant Examiner*—N. D. Patel

[57] ABSTRACT

A Double Sliding Spark Plug as a Volume Ignition System for Internal Combustion Engines causes ignition processes of the air-fuel mixture by two simultaneously conical or cylindrical sliding discharges between a conical or cylindrical high voltage electrode (1) located inside two solid insulation parts (4) and (5) and two circular low voltage electrodes (2) and (3). Those sliding discharges are on outer large conical or cylindrical surfaces of insulation parts (4) and (5) with high diameters. The outside low voltage electrode (2) is connected to a metallic body of this spark plug and to the outer conical or cylindrical surface of the outside insulation part (4). The inside cylindrical or conical low voltage electrode (3) is connected to the inner conical or cylindrical surface of the inside insulation part (5).

1 Claim, 1 Drawing Sheet

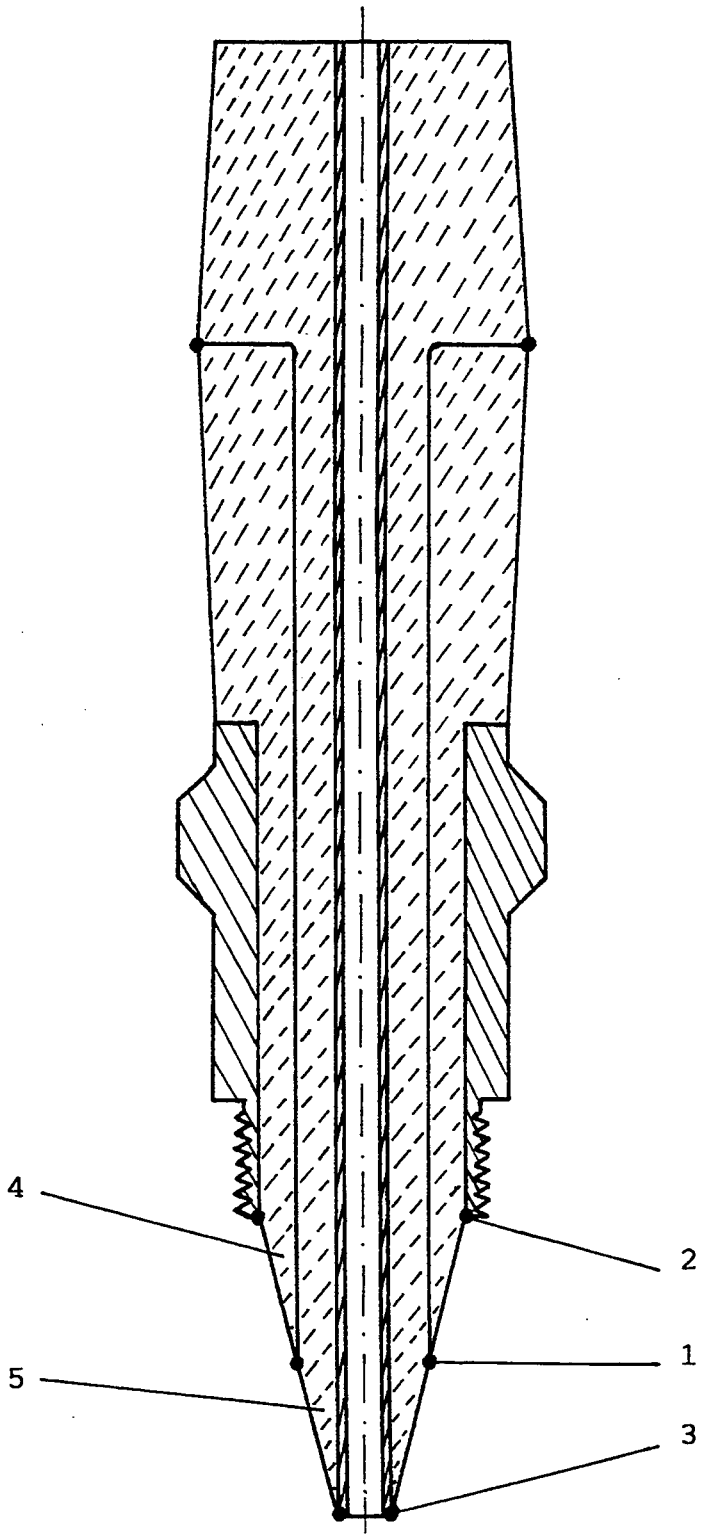
4
2
1
5
3

DOUBLE SLIDING SPARK PLUG - THUNDER II

TECHNICAL FIELD

The present invention relates to spark plugs for Internal Combustion Engines.

BACKGROUND ART

A typical Internal Combustion Engine is equipped with a spark plug generally similar to standard design including a body member supporting a pair of electrodes to provide a spark gap. This gap is about 1 mm long with a core diameter of spark about 0,1 mm. Transfer of electrical and heat energy to fuel through this very narrow shell around this spark is not efficient. Processes of ignition, combustion and increase of pressure in an engine's cylinder are long.

DISCLOSURE OF INVENTION

This invention is an effort to improve combustion efficiency, emission characteristics and better fuel economy by increasing sparks' and ignitions' areas causing transfer of higher level of electrical and heat energy into burning fuel.

There are created volume ignition processes instead of very small surface of ignition of fuel in a typical spark plug. Two sliding discharges are created on long conical or cylindrical surfaces with high diameter of insulation parts, between a high voltage electrode and two low voltage electrodes:

- the outside electrode connected to the sparks plug body and to the outer surface of the outside insulation part
- the inside electrode located centrally inside of the inside insulation part.

The high voltage electrode is located between the inside and the outside insulation parts.

Those sliding discharges can be very large for example 7,5 mm long (each) with the diameter from 5 mm up to 10 mm. And much higher level of electrical and heat energy can be transfered through those volume discharges into the air-fuel mixture causing volume ignition processes inside the engine's cylinder.

BRIEF DESCRIPTION OF THE DRAWING

The drawing is a sketch and advantages of the volume ignition processes by the double sliding discharges in an engine's cylinder. In this (FIGURE) drawing numbers represent:

1. a high voltage electrode 2. an outside low voltage electrode connected to a sparks' plug body and to an outside insulation part—4
3. an inside low voltage electrode located inside of an inside insulation part—5
4. an outside insulation (conical) part (with higher diameter)
5. an inside insulation (conical) part (with lower diameter).

BEST MODE FOR CARRYING OUT THE INVENTION

The drawing shows in schematic form the DOUBLE SLIDING SPARKS PLUG inside an engine's cylinder.

High voltage is applied to a high voltage electrode—1 with conical or cylindrical shape. Two sliding discharges are developing simultaneously between this high voltage electrode—1 and:

- a circular low voltage electrode—2 connected to a sparks plug's body—and to an insulation part—4 with conical or cylindrical inner and outer surfaces with high diameter
- a circular low voltage electrode—3 located inside insulation part—5 with conical or cylindrical inner and outer surfaces with a high diameter.

Those double conical or cylindrical sliding discharges are a volume ignition system of the air-fuel mixture in the engine's cylinder from the upper to the bottom part.

I claim:

1. A double sliding spark plug, for causing very fast ignition and combustion processes of the air-fuel mixture with very high air-fuel mixture ratio, comprising:

- a first low voltage circular electrode located longitudinally at the center of the spark plug, the first low voltage electrode having a first end facing a discharge end of the spark plug;
- a first circular longitudinal insulation portion surrounding the first low voltage electrode and defining a first surface exposed to the discharge end of the spark plug;
- a high voltage electrode surrounding the first insulation portion and having its first end exposed to the discharge end of the spark plug;
- a second circular longitudinal insulation portion surrounding the high voltage electrode and having a first surface exposed to discharge end of the spark plug and being co-planar with the first surface of the first insulation portion;
- a second low voltage circular electrode surrounding the second insulation portion and connecting to the metallic body of the spark plug.

* * * * *